US011939551B1

(12) United States Patent
Iyer et al.

(10) Patent No.: US 11,939,551 B1
(45) Date of Patent: Mar. 26, 2024

(54) LUBRICATING FLUID FOR AN ELECTRIC MOTOR SYSTEM

(71) Applicant: Afton Chemical Corporation, Richmond, VA (US)

(72) Inventors: Ramnath Iyer, Glen Allen, VA (US); Lisa Thalen, Fredericksburg, VA (US)

(73) Assignee: Afton Chemical Corporation, Richmond, VA (US)

( * ) Notice: Subject to any disclaimer, the term of this patent is extended or adjusted under 35 U.S.C. 154(b) by 0 days.

(21) Appl. No.: 18/342,202

(22) Filed: Jun. 27, 2023

(51) Int. Cl.

| | |
|---|---|
| ***C10M 159/12*** | (2006.01) |
| ***C10M 133/06*** | (2006.01) |
| ***C10M 135/36*** | (2006.01) |
| *C10N 20/04* | (2006.01) |
| *C10N 30/02* | (2006.01) |
| *C10N 40/14* | (2006.01) |
| *C10N 60/12* | (2006.01) |
| *C10N 60/14* | (2006.01) |

(52) U.S. Cl.
CPC ..... *C10M 159/126* (2013.01); *C10M 133/06* (2013.01); *C10M 135/36* (2013.01); *C10M 2215/026* (2013.01); *C10M 2215/042* (2013.01); *C10M 2219/104* (2013.01); *C10M 2225/04* (2013.01); *C10N 2020/04* (2013.01); *C10N 2030/02* (2013.01); *C10N 2040/14* (2013.01); *C10N 2060/12* (2013.01); *C10N 2060/14* (2013.01)

(58) Field of Classification Search
CPC ..... C10M 159/126; C10M 133/06; C10M 135/36; C10M 2215/026; C10M 2215/042; C10M 2219/104; C10M 2225/04; C10N 2020/04; C10N 2030/02; C10N 2040/14; C10N 2060/12; C10N 2060/14
See application file for complete search history.

(56) References Cited

U.S. PATENT DOCUMENTS

| | | | | |
|---|---|---|---|---|
| 4,859,352 | A | 8/1989 | Waynick | |
| 6,586,374 | B1 | 7/2003 | Paul | |
| 6,667,281 | B2 | 12/2003 | Ikejima et al. | |
| 6,903,056 | B2 | 6/2005 | Nagano et al. | |
| 8,143,202 | B2 | 3/2012 | Peer et al. | |
| 8,400,030 | B1 | 3/2013 | Tang et al. | |
| 8,563,486 | B2 | 10/2013 | Tsujimoto et al. | |
| 8,664,169 | B2 | 3/2014 | Bouffet | |
| 8,901,052 | B2 | 12/2014 | Sagawa et al. | |
| 8,999,904 | B2 | 4/2015 | Matsui et al. | |
| 9,522,972 | B2 | 12/2016 | Visger et al. | |
| 9,574,156 | B2 | 2/2017 | Tang et al. | |
| 9,598,658 | B2 | 3/2017 | Scanlon et al. | |
| 9,896,634 | B2 | 2/2018 | Gao et al. | |
| 9,944,877 | B2 | 4/2018 | Gao et al. | |
| 11,326,123 | B1 | 5/2022 | Adhvaryu et al. | |
| 11,479,735 | B2 | 10/2022 | Iyer et al. | |
| 2002/0151441 | A1 | 10/2002 | Srinivasan | |
| 2002/0151443 | A1 | 10/2002 | Srinivasan | |
| 2007/0037715 | A1 | 2/2007 | Okada | |
| 2008/0194442 | A1 | 8/2008 | Watts et al. | |
| 2008/0302422 | A1 | 12/2008 | Neveu et al. | |
| 2010/0130390 | A1 | 5/2010 | Tipton | |
| 2012/0208731 | A1 | 8/2012 | Lann et al. | |
| 2012/0283159 | A1 | 11/2012 | Matsui et al. | |
| 2013/0225461 | A1* | 8/2013 | Barton | C10M 137/08 508/428 |
| 2014/0162919 | A1* | 6/2014 | Fu | C10M 141/08 508/281 |
| 2014/0249061 | A1 | 9/2014 | Youn et al. | |
| 2014/0296118 | A1 | 10/2014 | Costello et al. | |
| 2015/0038385 | A1* | 2/2015 | Barton | C10M 141/08 508/415 |
| 2015/0322322 | A1 | 11/2015 | Sondjaja, et al. | |
| 2016/0024416 | A1 | 1/2016 | Kamano | |
| 2016/0108337 | A1 | 4/2016 | Abraham et al. | |
| 2016/0281020 | A1* | 9/2016 | Yamamoto | C10M 141/10 |
| 2017/0130161 | A1 | 5/2017 | Vettel et al. | |
| 2017/0306259 | A1 | 10/2017 | Ding et al. | |
| 2018/0072962 | A1 | 3/2018 | Wada et al. | |
| 2018/0079990 | A1 | 3/2018 | Aoyama | |
| 2018/0100114 | A1 | 4/2018 | Gao et al. | |
| 2018/0100115 | A1 | 4/2018 | Gao et al. | |
| 2018/0100117 | A1 | 4/2018 | Flores-Torres et al. | |
| 2018/0100118 | A1 | 4/2018 | Flores-Torres et al. | |
| 2018/0100119 | A1 | 4/2018 | Aoyama | |
| 2018/0134983 | A1 | 5/2018 | Broutin et al. | |
| 2018/0327687 | A1 | 11/2018 | Kwak | |
| 2019/0002785 | A1 | 1/2019 | Sanson et al. | |
| 2019/0002790 | A1 | 1/2019 | Sanson et al. | |

(Continued)

FOREIGN PATENT DOCUMENTS

| | | | |
|---|---|---|---|
| FR | 3097873 | A1 | 1/2021 |
| WO | 2014186318 | A1 | 11/2014 |

(Continued)

*Primary Examiner* — Cephia D Toomer
(74) *Attorney, Agent, or Firm* — Honigman LLP

(57) ABSTRACT

An electric motor driveline fluid for an electric motor system including a lubricating base oil, at least one sulfurized component, and at least one dispersant derived from a polyisobutylene having an average number molecular weight of at least 2000. The electric motor driveline fluid provides acceptable wear performance as well as good electrical conductivity and oxidative stability for use in electric motor system fluids having a low viscosity when select elemental relationships of phosphorus, sulfur, and calcium and included in the fluid.

24 Claims, No Drawings

(56) References Cited

U.S. PATENT DOCUMENTS

| | | | |
|---|---|---|---|
| 2019/0078034 | A1 | 3/2019 | Saccomando et al. |
| 2019/0112541 | A1 | 4/2019 | Hamachi |
| 2019/0367830 | A1 | 12/2019 | Iwai |
| 2020/0248095 | A1 | 8/2020 | Guerin |
| 2020/0277542 | A1 | 9/2020 | Salvi et al. |
| 2021/0009920 | A1 | 1/2021 | Kwak |

FOREIGN PATENT DOCUMENTS

| | | | |
|---|---|---|---|
| WO | 2017189277 | A1 | 11/2017 |
| WO | 2017210388 | A1 | 12/2017 |

* cited by examiner

LUBRICATING FLUID FOR AN ELECTRIC MOTOR SYSTEM

TECHNICAL FIELD

The present disclosure relates to a lubricating fluid for an electric motor system and a method of lubricating a driveline in the electric motor system. In particular, the disclosed methods and lubricating fluid relate to a lower viscosity lubricating fluid for use in an electric motor and/or driveline of an electric or hybrid-electric vehicle including an oil of lubricating viscosity and at least one higher molecular weight dispersant.

BACKGROUND

A major challenge in developing electric vehicle driveline lubricants is achieving acceptable wear performance as well as maintaining oxidative stability, while ensuring lubricant compatibility with the electrified components in the driveline. Because lubricants in electric or hybrid-electric vehicles may also contact components in the electric motor, the fluid's electrical conductivity also needs to be relatively low to inhibit electrostatic buildup and discharge of the electrified components.

To improve efficiency, lubricant manufacturers often seek to lower lubricant viscosity, but lower viscosity fluids are often less desirable for the demanding wear tests often required by industry and/or automotive manufacturers. As such, lower viscosity fluids may often require additional antiwear additives to meet the required wear tests. However, adding these additional additives often increases the electrical conductivity and/or decreases the oxidative or viscosity stability of the lubricant.

It is also common to include one or more friction modifiers in conventional transmission lubricants for, among other things, improved shudder durability. Lubricants for electric vehicle drivelines, however, tend to be negatively impacted by high levels of friction modifiers, which can interfere with the performance of other components in the lubricant, such as the antiwear additives. In the context of a lower viscosity lubricant configured for an electric or hybrid-electric vehicle, therefore, achieving desired performance in antiwear, oxidization stability, conductivity, corrosion, and/or friction performance can be challenging.

SUMMARY

In one approach or embodiment, an electric driveline fluid suitable for electric or hybrid-electric vehicles is described herein. In an aspect of this approach or embodiment, the electric driveline fluid includes one or more base oils of lubricating viscosity; a succinimide dispersant derived from a polyisobutylene having a number average molecular weight of about 2,000 or greater, wherein the succinimide dispersant has up to about 1 weight percent nitrogen and is post treated with a phosphorus containing compound and a boron containing compound, and wherein the succinimide dispersant delivers about 150 to about 270 ppm of dispersant phosphorus (P) to the electric driveline fluid; a sulfur-providing additive including a thiadiazole or derivative thereof, wherein the thiadiazole or derivative thereof provides at least about 1000 ppm of thiadiazole sulfur (S) to the electric driveline fluid; wherein the combined dispersant phosphorus and thiadiazole sulfur (P+S) is at least about 1300 ppm and wherein a weight ratio of the dispersant phosphorus to the thiadiazole sulfur (P/S) is at least about 0.1; a detergent system providing one or more calcium-containing detergents, and wherein the one or more calcium-containing detergents provide no more than about 200 ppm of calcium; no more than about 0.4 weight percent of a friction modifier; and wherein the electric driveline fluid has a kV100 viscosity of about 3.2 cSt or more, about 150 to about 270 ppm of total phosphorus, and an electrical conductivity of about 130 nS/M or less as measured by a modified conductivity test pursuant to ASTM D2624-15 using the electric driveline fluid and measured at 20 Hz and at 170° C.

In other approaches or embodiments, the electric driveline fluid of the previous paragraph may include one or more optional features or embodiments in any combination. These optional features or embodiments may include one or more of the following: wherein the friction modifier is an alkyl imide, an alkyl amine, a hydrocarbyl imidazole, derivatives thereof, or combinations thereof, and/or wherein the friction modifier comprises 0 to about 0.4 weight percent of one or more of a linear or branched C16 to C18 substituted succinic acid or anhydride reacted with an amine, polyamine, or ammonia (preferably, reacted with ammonia), 0 to about 0.08 weight percent of ethoxylated alkyl amine (preferably, ethoxylated tallow amine); and/or wherein the friction modifier is 0 to about 0.1 weight percent of a linear or branched C16 to C18 substituted succinic acid or anhydride reacted with an amine, polyamine, or ammonia (preferably reacted with ammonia); and/or wherein the number average molecular weight of the polyisobutylene is about 2,000 to about 2,400; and/or wherein the electric motor lubricating fluid includes about 2 to about 8 weight percent of the succinimide dispersant (preferably, about 4 to about 8 weight percent); and/or wherein the electric driveline fluid has a change in viscosity of less than about 0.5 cSt after the electric driveline fluid has been aged according to CEC L-48-A; and/or wherein the electric driveline fluid achieves a failure load stage of at least about 8 in the FZG A10/16.6R/120 scuffing test of CEC L-84-02; and/or wherein the thiadiazole or derivative thereof provides about 1500 ppm or less of sulfur; and/or wherein the combined dispersant phosphorus and thiadiazole sulfur (P+S) is about 1300 ppm to about 1400 ppm; and/or wherein the weight ratio of the dispersant phosphorus to the thiadiazole sulfur (P/S) is about 0.1 to about 0.3; and/or wherein about 90 to about 100 percent of the total phosphorus is provided by the succinimide dispersant; and/or wherein the amount of provided phosphorus is about 1 ppm of phosphorus per each 8 to 13 number average molecular weight units of the polyisobutylene moiety of the succinimide dispersant; and/or wherein the thiadiazole or derivative thereof includes one or more compounds having a structure of Formula I:

(Formula III)

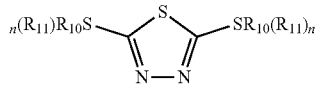

wherein each $R_{10}$ of Formula III is, independently, hydrogen or sulfur; each $R_{11}$ of Formula III is, independently, an alkyl group; n is an integer of 0 or 1 and if $R_{10}$ is hydrogen then the integer n of the adjacent $R_{11}$ moiety is 0 and if $R_{10}$ is sulfur then the n of the adjacent $R_{11}$ moiety is 1; and wherein at least one $R_{10}$ is sulfur.

In another approach or embodiment, a method for lubricating a driveline component including an electric motor is described herein. In aspects of this embodiment, the method includes lubricating the driveline component with an electric driveline fluid and, in some embodiments, the electric driveline fluid contacts portions of the electric motor. In other aspects of this embodiment, the electric driveline fluid includes (i) one or more base oils of lubricating viscosity; (ii) a succinimide dispersant derived from a polyisobutylene having a number average molecular weight of about 2,000 or greater, wherein the succinimide dispersant has up to about 1 weight percent nitrogen and is post treated with a phosphorus containing compound and a boron containing compound, and wherein the succinimide dispersant delivers about 150 to about 270 ppm of dispersant phosphorus (P) to the electric driveline fluid; (iii) a sulfur-providing additive including a thiadiazole or derivative thereof providing at least about 1000 ppm of thiadiazole sulfur (S) to the electric driveline fluid (preferably about 1000 to about 1400 ppm), wherein the combined dispersant phosphorus and thiadiazole sulfur (P+S) is at least about 1300 ppm (preferably about 1300 to about 1400) and wherein a weight ratio of the dispersant phosphorus to the thiadiazole sulfur (P/S) is at least about 0.1 (preferably about 0.1 to about 0.3); (iv) a detergent system providing one or more calcium-containing detergents, wherein the one or more calcium-containing detergents provide no more than about 200 ppm of calcium; and (v) no more than about 0.4 weight percent of a friction modifier; and wherein the electric driveline fluid has a kV100 viscosity of about 3.2 cSt or more, about 150 to about 270 ppm of total phosphorus, and an electrical conductivity of about 130 nS/M or less as measured by a modified conductivity test pursuant to ASTM D2624-15 using the electric driveline fluid and measured at 20 Hz and at 170° C.

In yet further approaches or embodiments, the method for lubricating a driveline component including an electric motor as described in the previous paragraph may include one or more optional method steps, features, or embodiments in any combination. These optional method steps, features, or embodiments may include one or more of the following: wherein the friction modifier is an alkyl imide, an alkyl amine, a hydrocarbyl imidazole, derivatives thereof, or combinations thereof, and/or wherein the friction modifier is 0 to about 0.08 weight percent of an ethoxylated alkyl amine (preferably, ethoxylated tallow amine); and/or wherein the organic friction modifier is 0 to about 0.4 weight percent of a linear or branched C16 to C18 substituted succinic acid or anhydride reacted with an amine, polyamine, or ammonia (preferably, reacted with ammonia); and/or wherein the number average molecular weight of the polyisobutylene is about 2,000 to about 2,400; and/or wherein the electric driveline fluid includes about 2 to about 8 weight percent of the succinimide dispersant (preferably, about 4 to about 8 weight percent); and/or wherein the electric driveline fluid has a change in viscosity of less than about 0.5 cST after the electric driveline fluid has been aged according to CEC L-48-A; and/or wherein the electric driveline fluid achieves a failure load stage of at least about 8 in the FZG A10/16.6R/120 scuffing test of CEC L-84-02; and/or wherein about 90 to about 100 percent of the total phosphorus is provided by the succinimide dispersant; and/or wherein the thiadiazole or derivative thereof includes one or more compounds having a structure of Formula III:

(Formula III)

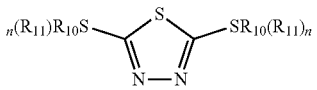

wherein each $R_{10}$ is, independently, hydrogen or sulfur; each $R_{11}$ is, independently, an alkyl group; n is an integer of 0 or 1 and if $R_{10}$ is hydrogen then the integer n of the adjacent $R_{11}$ moiety is 0 and if $R_{10}$ is sulfur then the n of the adjacent $R_{11}$ moiety is 1; and wherein at least one $R_{10}$ is sulfur.

In yet other approaches or embodiments, the use of an electric driveline fluid is described herein to achieve one or more of (i) an electrical conductivity of about 130 nS/M or less as measured by a modified conductivity test pursuant to ASTM D2624-15 using the electric driveline fluid and measured at 20 Hz and at 170° C.; (ii) a change in viscosity of less than about 0.5 cST after the electric driveline fluid has been aged according to CEC L-48-A; and/or (iii) a failure load stage of at least about 8 in the FZG A10/16.6R/120 scuffing test of CEC L-84-02. In such embodiments, the electric driveline fluid includes any embodiment as described in this Summary and at least includes (i) one or more base oils of lubricating viscosity; (ii) a succinimide dispersant derived from a polyisobutylene having a number average molecular weight of about 2,000 or greater, wherein the succinimide dispersant has up to about 1 weight percent nitrogen and is post treated with a phosphorus containing compound and a boron containing compound, and wherein the succinimide dispersant delivers about 150 to about 270 ppm of dispersant phosphorus (P) to the electric driveline fluid; (iii) a sulfur-providing additive including a thiadiazole or derivative thereof providing at least about 1000 ppm of thiadiazole sulfur (S) to the electric driveline fluid (preferably about 1000 to about 1400 ppm), wherein the combined dispersant phosphorus and thiadiazole sulfur (P+S) is at least about 1300 ppm (preferably about 1300 to about 1400) and wherein a weight ratio of the dispersant phosphorus to the thiadiazole sulfur (P/S) is at least about 0.1 (preferably about 0.1 to about 0.3); (iv) a detergent system providing one or more calcium-containing detergents, wherein the one or more calcium-containing detergents provide no more than about 200 ppm of calcium; and (v) no more than about 0.4 weight percent of a friction modifier; and wherein the electric driveline fluid has a kV100 viscosity of about 3.2 cSt or more, about 150 to about 270 ppm of total phosphorus.

Other embodiments of the present disclosure will be apparent to those skilled in the art from consideration of the specification and practice of the invention disclosed herein.

The following definitions of terms are provided in order to clarify the meanings of certain terms as used herein.

The terms "lubricating oil," "lubricant composition," "lubricating composition," "lubricant" and "lubricating and cooling fluid" refer to a finished lubrication product comprising a major amount of a base oil plus a minor amount of an additive composition.

As used herein, the terms "additive package," "additive concentrate," and "additive composition," refer the portion of the lubricating oil composition excluding the major amount of base oil.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having a predominantly hydrocarbon character. Each hydrocarbyl group is independently selected from hydrocarbon substituents, and substituted hydrocarbon substituents containing one or more of halo groups, hydroxyl groups, alkoxy groups, mercapto groups, nitro groups, nitroso groups, amino groups, pyridyl groups, furyl groups, imidazolyl groups, oxygen and nitrogen, and wherein no more than two non-hydrocarbon substituents are present for every ten carbon atoms in the hydrocarbyl group.

As used herein, the term "percent by weight" or "wt %", unless expressly stated otherwise, means the percentage the recited component represents to the weight of the entire composition.

The terms "soluble," "oil-soluble," or "dispersible" used herein may, but does not necessarily, indicate that the compounds or additives are soluble, dissolvable, miscible, or capable of being suspended in the oil in all proportions. The foregoing terms do mean, however, that they are, for instance, soluble, suspendable, dissolvable, or stably dispersible in oil to an extent sufficient to exert their intended effect in the environment in which the oil is employed. Moreover, the additional incorporation of other additives may also permit incorporation of higher levels of a particular additive, if desired.

The term "alkyl" as employed herein refers to straight, branched, cyclic, and/or substituted saturated chain moieties from about 1 to about 200 carbon atoms.

The term "alkenyl" as employed herein refers to straight, branched, cyclic, and/or substituted unsaturated chain moieties from about 3 to about 30 carbon atoms.

The term "aryl" as employed herein refers to single and multi-ring aromatic compounds that may include alkyl, alkenyl, alkylaryl, amino, hydroxyl, alkoxy, halo substituents, and/or heteroatoms including, but not limited to, nitrogen, and oxygen.

As used herein, the "average number molecular weight" or "Mn" is determined by gel permeation chromatography (GPC) using commercially available polystyrene standards (with a Mn of about 180 to about 18,000 as the calibration reference).

It is to be understood that throughout the present disclosure, the terms "comprises," "includes," "contains," etc. are considered open-ended and include any element, step, or ingredient not explicitly listed. The phrase "consists essentially of" is meant to include any expressly listed element, step, or ingredient and any additional elements, steps, or ingredients that do not materially affect the basic and novel aspects of the invention. The present disclosure also contemplates that any composition described using the terms, "comprises," "includes," "contains," is also to be interpreted as including a disclosure of the same composition "consisting essentially of" or "consisting of" the specifically listed components thereof.

DETAILED DESCRIPTION

According to exemplary embodiments, a lower viscosity driveline lubricant suitable for electric or hybrid-electric vehicles is described herein with select elemental relationships that surprisingly achieve passing performance in the demanding FZG scuffing tests, such as the A10/16.6R/90 test of CEC L-84-02 and, at the same time, achieving good electrical conductivity and maintaining oxidative stability. What is surprising about the lubricating fluids herein, however, is that the combination of certain additives, including a succinimide dispersant derived from a polyisobutylene having a number average molecular number of greater than 2000, were found helpful to achieve passing wear, conductivity, and oxidation performance when such dispersant was used in combination with select phosphorus, sulfur, and calcium elemental relationships. In some embodiments, it was also discovered that certain friction modifiers need to be limited in the compositions.

When the selected succinimide dispersants herein were combined with other lubricant additives and having the certain elemental relationships (for instance, relationships of the phosphorus, sulfur, and/or calcium discussed more below) to form the finished lubricants, the finished lubricants herein achieved a lower viscosity, passing scuffing performance, suitable conductivity, and/or oxidative stability making the fluids suitable for drivelines of electric or hybrid-electric vehicles.

The fluids herein include at least (i) a succinimide dispersant derived from polyisobutylene having a number average molecular weight of about 2,000 or greater, wherein the succinimide dispersant has up to about 1 weight percent nitrogen and is post treated with a phosphorus containing compound and a boron containing compound, and wherein the succinimide dispersant delivers about 150 to about 270 ppm of dispersant phosphorus (P) to the electric driveline fluid and (ii) a sulfur-providing additive including a thiadiazole or derivative thereof, wherein the thiadiazole or derivative thereof provides at least about 1000 ppm of sulfur (S) to the electric driveline fluid. It was further discovered that to achieve performance for electric or hybrid-electric vehicles, the combined amount of phosphorus delivered from the dispersant phosphorus and sulfur delivered from the thiadiazole or derivative thereof (P+S) needs to be at least about 1300 ppm (preferably, about 1300 ppm to about 2000 ppm, about 1300 ppm to about 1600 ppm, or about 1300 ppm to about 1400 ppm) and a weight ratio of the phosphorus delivered from the dispersant phosphorus to the sulfur delivered from the thiadiazole or derivative thereof (P/S) needs to be at least about 0.1 (preferably, about 0.1 to about 0.5, about 0.1 to about 0.4, or about 0.1 to about 0.3).

In addition, other embodiments of the lubricants herein also include select detergent systems and/or select friction modifier systems to achieve performance suitable for hybrid and/or hybrid-electric vehicles. In one embodiment, the lubricants herein further include a detergent system providing one or more calcium-containing detergents but with only limited amounts of calcium. Preferably, the detergent systems include one or more calcium-containing detergents providing no more than about 200 ppm of calcium. In yet other embodiments, the lubricants herein may further include a selected friction modifier system having no more than about 0.4 weight percent of friction modifier comprising an alkyl amide, an alkyl imide, an alkyl amine, a hydrocarbyl amine, a hydrocarbyl polyamine, a hydrocarbyl imidazole, derivatives thereof, or combinations thereof. As discussed more below, the lubricants herein may include only limited amounts of ethoxylated alkyl amine friction modifiers and/or limited amounts of alkylated succinic acid or anhydride or derivatives thereof. For example, the lubricants herein may include less than 0.1 weight percent of ethoxylated alkyl amine (preferably, ethoxylated tallow amine) and/or less than 0.3 weight percent of friction modifiers comprising alkylated succinic acid or anhydride or derivatives thereof.

When the electric driveline fluids herein have a relatively low kV100 viscosity of about 3.2 cSt or more (preferably, about 3.2 cSt to about 7 cSt) and about 150 to about 270 ppm of total phosphorus combined with the other components, relationships, and systems set forth above, the lubricants exhibit a low electrical conductivity, passing antiwear performance, and/or desired oxidative stability at the same time. For instance, the fluids herein exhibit one or more of the following: (i) an electrical conductivity of about 130 nS/M or less as measured by a modified conductivity test pursuant to ASTM D2624-15 using the electric driveline fluid and measured at 20 Hz and at 170° C.; (ii) a change in viscosity of less than about 0.5 cSt after the electric driveline fluid has been aged according to CEC L-48-A; and/or (iii) a failure load stage of at least about 8 in the FZG A10/16.6R/120 scuffing test of CEC L-84-02. Each of the component additives, relationships, and systems is further described below.

Succinimide Dispersant:

The electric motor driveline fluids herein contain a dispersant system with at least one oil-soluble ashless dispersant that is preferably a succinimide dispersant derived from a polyisobutylene having a number average molecular weight of about 2,000 or greater and that is also post treated with a phosphorus-containing compound and a boron-containing compound. Succinimide dispersants herein can be derived from hydrocarbyl-substituted dicarboxylic acids or anhydrides reacted with polyalkylene polyamines. Succinimide dispersants and their preparation are disclosed in at least U.S. Pat. Nos. 7,897,696 and/or 4,234,435, which are incorporated herein by reference.

The hydrocarbyl moiety of the hydrocarbyl-dicarboxylic acid or anhydride of may be derived from butene polymers, for example, polymers of isobutylene. Suitable polyisobutylenes for use herein include those formed from conventional polyisobutylene or highly reactive polyisobutylene having at least 60%, such as 70% to 90% and above, terminal vinylidene content. Suitable polyisobutylenes may include those prepared using BF3 catalysts.

The number average molecular weight of the polyisobutylene substituent of the dispersants herein may vary from at least about 2,000 and, in some instances, up to about 3,000, as determined by gel permeation chromatography (GPC) using polystyrene (with a number average molecular weight of 180 to about 18,000) as the calibration reference. The GPC method additionally provides average weight molecular weight distribution information; see, for example, W. W. Yau, J. J. Kirkland and D. D. Bly, "Modern Size Exclusion Liquid Chromatography", John Wiley and Sons, New York, 1979, also incorporated herein by reference.

The polyisobutylene moiety in the dispersants herein may also have a molecular weight distribution (MWD), also referred to as polydispersity index, as determined by the ratio of weight average molecular weight (Mw) to number average molecular weight (Mn). In some approaches or embodiments, suitable polyisobutylene moieties may have a Mw/Mn of less than about 3.0, or less than about 2.8, or less than about 2.5, and in other approaches, suitable polyisobutylene substituents have a polydispersity of from about 1.5 to about 3.0, or from about 2.0 to about 3.0.

The dicarboxylic acid or anhydride suitable to form the dispersants herein may be selected from carboxylic reactants such as maleic anhydride, maleic acid, fumaric acid, malic acid, tartaric acid, itaconic acid, itaconic anhydride, citraconic acid, citraconic anhydride, mesaconic acid, ethylmaleic anhydride, dimethylmaleic anhydride, ethylmaleic acid, dimethylmaleic acid, hexylmaleic acid, and the like, including the corresponding acid halides and C1-C4 aliphatic esters. In some approaches, a mole ratio of dicarboxylic acid or anhydride to hydrocarbyl moiety in a reaction mixture used to make the hydrocarbyl-dicarboxylic acid or anhydride may vary widely. Accordingly, the charge mole ratio may vary from 5:1 to 1:5, for example from 3:1 to 1:3. In some embodiments, a particularly suitable molar ratio of acid or anhydride to hydrocarbyl moiety is from 1:1 to less than 1.6:1. In other embodiments, another useful charge molar ratio of dicarboxylic acid or anhydride to hydrocarbyl moiety may be 1:1 to 1.5:1, or 1:1 to 1.4:1, or 1.1:1 to 1.3:1, or 1:1 to 1.2:1.

Any of numerous polyalkylene polyamines can be used as in preparing the dispersant additives herein. Non-limiting exemplary polyamines may include aminoguanidine bicarbonate (AGBC), diethylene triamine (DETA), triethylene tetramine (TETA), tetraethylene pentamine (TEPA), pentaethylene hexamine (PEHA) and heavy polyamines. A heavy polyamine may comprise a mixture of polyalkylenepolyamines having small amounts of polyamine oligomers such as TEPA and PEHA, but primarily oligomers having seven or more nitrogen atoms, two or more primary amines per molecule, and more extensive branching than conventional polyamine mixtures. Typically, these heavy polyamines have an average of 6.5 nitrogen atoms per molecule. Additional non-limiting polyamines which may be used to prepare the hydrocarbyl-substituted succinimide dispersant are disclosed in U.S. Pat. No. 6,548,458, the disclosure of which is incorporated herein by reference in its entirety. In some embodiments, the charge molar ratio of hydrocarbyl-dicarboxylic acid or anhydrides to polyalkylene polyamines may be from about 1:1 to about 3.0:1. In one embodiment, the dispersants in the present disclosure described herein may be the reaction product of a polyisobutenyl succinic anhydride (PIBSA), and a polyamine, for example heavy polyamines wherein the charge molar ratio of the polyisobutenyl-substituted succinic anhydride to the polyamine of about 1.7:1 to about 2.5:1.

As noted above, the succinimide dispersants herein may be post treated with a boron compound. Suitable boron compounds useful in forming the dispersants herein include any boron compound or mixtures of boron compounds capable of introducing boron-containing species into the ashless dispersant. Any boron compound, organic or inorganic, capable of undergoing such reaction can be used. Accordingly, use can be made of boron oxide, boron oxide hydrate, boron trifluoride, boron tribromide, boron trichloride, HBF4 boron acids such as boronic acid (e.g. alkyl-B(OH)2 or aryl-B(OH)2), boric acid, (i.e., H3BO3), tetraboric acid (i.e., H2B5O7), metaboric acid (i.e., HBO2), ammonium salts of such boron acids, and esters of such boron acids. The use of complexes of a boron trihalide with ethers, organic acids, inorganic acids, or hydrocarbons is a convenient means of introducing the boron reactant into the reaction mixture. Such complexes are known and are exemplified by boron trifluoride-diethyl ether, boron trifluoride-phenol, boron trifluoride-phosphoric acid, boron trichloride-chloroacetic acid, boron tribromide-dioxane, and boron trifluoride-methyl ethyl ether.

The succinimide dispersants herein may also be post treated with a phosphorus compound. Suitable phosphorus compounds for forming the dispersants herein include phosphorus compounds or mixtures of phosphorus compounds capable of introducing a phosphorus-containing species into the ashless dispersant. Any phosphorus compound, organic or inorganic, capable of undergoing such reaction can thus be used. Accordingly, use can be made of such inorganic phosphorus compounds as the inorganic phosphorus acids, and the inorganic phosphorus oxides, including their hydrates. Typical organic phosphorus compounds include full and partial esters of phosphorus acids, such as mono-, di-, and tri esters of phosphoric acid, thiophosphoric acid, dithiophosphoric acid, trithiophosphoric acid and tetrathiophosphoric acid; mono-, di-, and tri esters of phosphorous acid, thiophosphorous acid, dithiophosphorous acid and trithiophosphorous acid; trihydrocarbyl phosphine oxide;

trihydrocarbyl phosphine sulfide; mono- and dihydrocarbyl phosphonates, (RPO(OR')(OR") where R and R' are hydrocarbyl and R" is a hydrogen atom or a hydrocarbyl group), and their mono-, di- and trithio analogs; mono- and dihydrocarbyl phosphonites, (RP(OR')(OR") where R and R' are hydrocarbyl and R" is a hydrogen atom or a hydrocarbyl group) and their mono- and dithio analogs; and the like. Thus, use can be made of such compounds as, for example, phosphorous acid (H3PO3, sometimes depicted as H2(HPO3), and sometimes called ortho-phosphorous acid or phosphonic acid), phosphoric acid (H3PO4, sometimes called orthophosphoric acid), hypophosphoric acid (H4P2O6), metaphosphoric acid (HPO3), pyrophosphoric acid (H4P2O7), hypophosphorous acid (H3PO2, sometimes called phosphinic acid), pyrophosphorous acid (H4P2O5, sometimes called pyrophosphonic acid), phosphinous acid (H3PO), tripolyphosphoric acid (H5P3O10), tetrapolyphosphoric acid (H5P4O13), trimetaphosphoric acid (H3P3O9), phosphorus trioxide, phosphorus tetraoxide, phosphorus pentoxide, and the like. Partial or total sulfur analogs such as phosphorotetrathioic acid (H3PS4) acid, phosphoromonothioic acid (H3PO3S), phosphorodithioic acid (H3PO2S2), phosphorotrithioic acid (H3POS3), phosphorus sesquisulfide, phosphorus heptasulfide, and phosphorus pentasulfide (P2S5, sometimes referred to as P4S10) can also be used in forming dispersants for this disclosure. Also usable, are the inorganic phosphorus halide compounds such as PCl3, PBr3, POCl3, PSCl3, etc.

Likewise, use can be made of such organic phosphorus compounds as mono-, di-, and triesters of phosphoric acid (e.g., trihydrocarbyl phosphates, dihydrocarbyl monoacid phosphates, monohydrocarbyl diacid phosphates, and mixtures thereof), mono-, di-, and triesters of phosphorous acid (e.g., trihydrocarbyl phosphites, dihydrocarbyl hydrogen phosphites, hydrocarbyl diacid phosphites, and mixtures thereof), esters of phosphonic acids (both "primary", RP(O)(OR)2, and "secondary". R2P(O)(OR)), esters of phosphinic acids, phosphonyl halides (e.g., RP(O)Cl2 and R2P(O)Cl), halophosphites (e.g., (RO)PCl2 and (RO) 2PCl), halophosphates (e.g., ROP(O)Cl2 and (RO) 2P(O)Cl), tertiary pyrophosphate esters (e.g., (RO) 2P(O)—O—P(O)(OR) 2), and the total or partial sulfur analogs of any of the foregoing organic phosphorus compounds, and the like wherein each hydrocarbyl group contains up to 100 carbon atoms, preferably up to 50 carbon atoms, more preferably up to 24 carbon atoms, and most preferably up to 12 carbon atoms. Also usable are the halophosphine halides (e.g., hydrocarbyl phosphorus tetrahalides, dihydrocarbyl phosphorus trihalides, and trihydrocarbyl phosphorus dihalides), and the halophosphines (mono halophosphines and dihalophosphines).

In one embodiment, the succinimide dispersants of the fluids herein includes at least a polyisobutenyl moiety having a number average molecular weight of at least about 2000, and in other approaches, about 2000 to about 3000, or in yet further approaches, about 2000 to about 2300, and has about 0.5 to about 1 wt % of nitrogen, about 0.05 to about 0.25 wt % boron, and about 0.20 to about 0.45 wt % phosphorus, or in yet further embodiments, includes at least a polyisobutenyl moiety having a number average molecular weight of between 2000 and 2300 and has about 0.60 to about 0.90 wt % nitrogen, about 0.10 to about 0.20 wt % boron, and about 0.25 to about 0.40 wt % phosphorus.

In some embodiments, the dispersant described herein comprises about 2 to about 8 weight percent (preferably, about 4 to about 8 weight percent) of an electric motor driveline fluid and delivers about 300 to about 600 ppm nitrogen, about 150 to about 270 ppm of phosphorus, and about 50 to about 120 ppm of boron to the finished fluid. As shown in the Examples below, when such succinimide dispersants are combined with the other fluid components, and in particular, select amounts of sulfur, boron, nitrogen, and/or phosphorus, the lubricants achieve passing wear and conductivity performance, and oxidative stability suitable for lubricants used in electric and/or hybrid-electric vehicle drivelines or powertrains.

Sulfur-Providing Additive:

The electric motor driveline fluid also includes a sulfur-providing additive in amounts to improve wear performance, conductivity, and oxidative stability when combined with the succinimide described above. In approaches or embodiments herein, the sulfur-providing additive may be one or more thiadiazole compounds or hydrocarbyl-substituted derivatives thereof in amounts to provide at least about 1000 ppm of sulfur to the lubricating fluids herein (preferably, about 1000 to about 1500 ppm sulfur, more preferably, about 1000 to about 1400 ppm sulfur, and most preferably, about 1000 to about 1300 ppm sulfur). In other approaches, the sulfur-providing compound may be a mixture of thiadiazole compounds or hydrocarbyl-substituted derivatives thereof. Examples of the thiadiazole compound that may be used include, but are not limited to, 2,5-dimercapto-1,3,4-thiadiazole, 2-mercapto-5-hydrocarbylthio-1,3,4-thiadiazole, 2-mercapto-5-hydrocarbyldithio-1,3,4-thiadiazole, 2,5-bis(hydrocarbylthio)-1,3,4-thiadiazole, or 2,5-bis(hydrocarbyldithio)-1,3,4-thiadiazoles. The 1,3,4-thiadiazoles are generally synthesized from hydrazine and carbon disulfide by known procedures. See, for example, U.S. Pat. Nos. 2,765,289; 2,749,311; 2,760,933; 2,850,453; 2,910,439; 3,663,561; 3,862,798; and 3,840,549.

In some embodiments, the form and amounts of the sulfur-providing additive herein contributes to the ability of the fluids to maintain a low conductivity and oxidative stability and also meeting other desired wear performance characteristics at the same time. In approaches, the thiadiazole or derivative thereof includes one or more compounds having a structure of Formula III:

(Formula III)

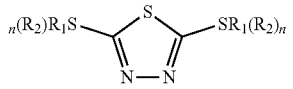

wherein each R1 of Formula III is independently hydrogen or sulfur, each R2 of Formula III is independently an alkyl group, n is an integer of 0 or 1 and if R1 is hydrogen then the integer n of the adjacent R2 moiety is 0 and if R1 is sulfur then the n of the adjacent R2 moiety is 1, and with the proviso that at least one R1 is sulfur. In other approaches, the thiadiazole additive is a blend of compounds of Formula IIIa and Formula IIIb shown below:

(Formula IIIa)

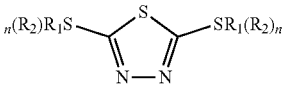

wherein within Formula IIIa each integer n is 1, each R1 is sulfur, and each R2 is a C5 to C15 alkyl group, preferably a C8 to C12 alkyl group; and (Formula IIIb)

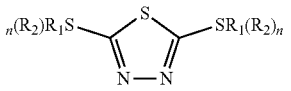

wherein within Formula IIIb one integer n is 1 with an associated R2 group being a C5 to C15 alkyl group (preferably a C8 to C12 alkyl group) and the other integer n is 0 and with both R1 groups being sulfur. In some embodiments, the sulfur-providing additive includes a blend of Formula IIIa and IIIb with Formula Iva being a majority of the blend and in other approaches, the blend of IIIa and IIIb is about 75 to about 90 weight percent of IIIa and about 10 to about 25 weight percent of IIIb (or other ranges therewithin). In another approach, the sulfur-providing additive is a 2,5 dimercapto 1,3,4 thiadiazole including a blend of 2,5-bis-(nonyldithio)-1,3,4-thiadiazole (such as about 75 to about 90%) and 2,5-mono-(nonyldithio)-1,3,4-thiadiazole (such as about 10 to about 25%).

The thiadiazole compound or hydrocarbyl-substituted derivatives thereof are present in the electric motor lubricating fluids herein in an amount to deliver at least about 1000 ppm sulfur, at least about 1100 ppm of sulfur, or at least about 1200 ppm of sulfur. In embodiments, the thiadiazole compound or hydrocarbyl-substituted derivatives thereof are present in the electric motor lubricating fluids herein in an amount to deliver about 1000 to about 1500 ppm of sulfur, in other embodiments, about 1000 to about 1400 ppm of sulfur, or about 1000 to about 1300 ppm of sulfur. In one embodiment, the thiadiazole compound is 2,5-dimercapto-1,3,4-thiadiazole and this thiadiazole compound or hydrocarbyl-substituted derivatives thereof are present in the lubricating fluids an amount to deliver about 1000 to about 1300 ppm sulfur (or other ranges therewithin).

Friction Modifiers:

In some embodiments, the electric motor driveline fluids herein contain only low levels of friction modifiers and, in particular, no more than about 0.4 weight percent of a friction modifier. Herein, the electric motor driveline fluid contain less than about 0.4 weight percent of friction modifier comprising alkyl amides, alkyl imides (having one or more alkyl C15-C30 alkyl chains), alkyl amines, hydrocarbyl amines, hydrocarbyl polyamines, hydrocarbyl imidazoles, derivatives thereof, or combinations thereof. In one embodiment, the electric driveline fluids herein may have friction modifiers, but no more than about 0.3 weight percent of a linear or branched C16 to C18 substituted succinic acid or anhydride reacted with ammonia. In another embodiment, the electric driveline fluids herein may contain no more than about 0.3 weight percent of a linear or branched C16 to C18 substituted succinic acid or anhydride reacted with amine, polyamine, or ammonia, and/or 0 to about 0.05 weight percent alkyl or alkenyl substituted imidazolines, and/or 0 to about 0.08 weight percent of an ethoxylated alkyl amine (preferably, an ethoxylated tallow amine).

In other embodiments, the electric driveline fluids herein may have no more than about 0.10 weight percent of friction modifiers including a linear or branched C16 to C18 substituted succinic acid or anhydride friction modifier or derivative thereof obtained via a reaction with an amine, polyamine, or ammonia (preferably, reacted with ammonia) and/or less than about 0.05 weight percent alkyl or alkenyl substituted imidazolines. In other embodiments, the electric driveline fluids herein may have no more than about 0.30 weight percent of friction modifiers including a linear or branched C16 to C18 substituted succinic acid or anhydride friction modifier or derivative thereof obtained via a reaction with an amine, polyamine, or ammonia and/or less than about 0.08 weight percent of an ethoxylated tallow alkyl amine.

In other embodiments, the limited amounts of friction modifiers in the lubricants herein may also include low amounts of any metal containing and/or low amounts of organic or metal-free friction modifiers and include only low amounts of such friction modifiers including imidazolines, amides, amines, succinimides, alkoxylated amines, alkoxylated ether amines, amine oxides, amidoamines, nitriles, betaines, quaternary amines, imines, amine salts, amino guanidine, alkanolamides, phosphonates, metal-containing compounds, glycerol esters, sulfurized fatty compounds and olefins, sunflower oil other naturally occurring plant or animal oils, dicarboxylic acid esters, esters or partial esters of a polyol and one or more aliphatic or aromatic carboxylic acids, and the like.

Friction modifiers that tend to be limited in the electric driveline lubricants herein may contain hydrocarbyl groups that are selected from straight chain, branched chain, or aromatic hydrocarbyl groups or mixtures thereof, and such hydrocarbyl groups may be saturated or unsaturated. The hydrocarbyl groups may be composed of carbon and hydrogen or hetero atoms such as sulfur or oxygen. The hydrocarbyl groups may range from 12 to 25 carbon atoms. In some embodiments the friction modifier may be a long chain fatty acid ester. In another embodiment the long chain fatty acid ester may be a mono-ester, or a di-ester, or a (tri) glyceride. The friction modifier may be a long chain fatty amide, a long chain fatty ester, a long chain fatty epoxide derivative, or a long chain imidazoline.

Other friction modifiers that tend to be limited in the lubricants herein may include organic, ashless (metal-free), nitrogen-free organic friction modifiers. Such friction modifiers may include esters formed by reacting carboxylic acids and anhydrides with alkanols and generally include a polar terminal group (e.g. carboxyl or hydroxyl) covalently bonded to an oleophilic hydrocarbon chain. An example of an organic ashless nitrogen-free friction modifier is known generally as glycerol monooleate (GMO) which may contain mono-, di-, and tri-esters of oleic acid. Other suitable friction modifiers are described in U.S. Pat. No. 6,723,685.

Aminic friction modifiers may also be limited in the lubricants herein and such friction modifiers may include amines or polyamines. Such compounds can have hydrocarbyl groups that are linear, either saturated or unsaturated, or a mixture thereof and may contain from 12 to 25 carbon atoms. Further examples of suitable friction modifiers include alkoxylated amines and alkoxylated ether amines. Such compounds may have hydrocarbyl groups that are linear, either saturated, unsaturated, or a mixture thereof. They may contain from about 12 to about 25 carbon atoms. Examples include ethoxylated amines and ethoxylated ether amines. The amines and amides may be used as such or in the form of an adduct or reaction product with a boron compound such as a boric oxide, boron halide, metaborate, boric acid or a mono-, di- or tri-alkyl borate. Other suitable friction modifiers are described in U.S. Pat. No. 6,300,291.

In any embodiment herein, the lubricants herein include no more than about 0.4 weight percent of total friction modifiers, if any, and in particular no more than about 0.4 weight percent of the above described types of friction modifiers. In some embodiments, the lubricants herein are substantially free of, or preferably, free of friction modifiers, which means the lubricants have no more than about 0.4 weight percent of such friction modifiers, no more than about 0.2 weight percent of friction modifiers, no more than about 0.1 weight percent of friction modifiers, no more than about 0.08 weight percent of friction modifiers, no more than about 0.06 weight percent of friction modifiers, no more than about 0.04 weight percent friction modifiers, no more than about 0.02 weight percent friction modifiers, no more than about 0.01 weight percent friction modifiers, or no function amounts of the above described friction modifiers.

Base Oil:

The electric motor driveline fluids herein include one or more base oils having a lubricating viscosity. Base oils suitable for use in formulating the electric motor lubricating fluids for use in electric and/or hybrid-electric motor vehicles according to the disclosure may be selected from any of suitable synthetic or natural oils or mixtures thereof having a suitable lubricating viscosity. Natural oils may include animal oils and vegetable oils (e.g., castor oil, lard oil) as well as mineral oils such as liquid petroleum oils and solvent treated or acid-treated mineral lubricating oils of the paraffinic, naphthenic or mixed paraffinic-naphthenic types. Oils derived from coal or shale may also be suitable. Further, oil derived from a gas-to-liquid process is also suitable. The base oil may have a kinematic viscosity at 100° C. of about 2 to about 6 cSt, as measured by ASTM D445.

The base oil as used in the invention described herein may be a single base oil or may be a mixture of two or more base oils. The one or more base oil(s) may be selected from any of the base oils in Groups III or IV as specified in the American Petroleum Institute (API) Base Oil Interchangeability Guidelines. Such base oil groups are shown in Table 1 as follows:

TABLE 1

| Base oil Category | Sulfur (%) | | Saturates (%) | Viscosity Index |
|---|---|---|---|---|
| API Group I | >0.03 | and/or | <90 | 80 to 120 |
| API Group II | ≤0.03 | and | ≥90 | 80 to 120 |
| API Group III | ≤0.03 | and | ≥90 | ≥120 |
| API Group IV | All polyalphaolefins (PAOs) | | | |
| API Group V | All others not included in Groups I, II, III, or IV | | | |

In one variation, the base oil may be selected from an API Group III base oil, or an API Group IV base oil, or a mixture of these base oils. Alternatively, the base oil may be a mixture of two or more of an API Group III base oils, or two or more of an API Group IV base oils.

API Group III base oils may include oil derived from Fischer-Tropsch synthesized hydrocarbons. Fischer-Tropsch synthesized hydrocarbons are made from synthesis gas containing H2 and CO using a Fischer-Tropsch catalyst. Such hydrocarbons typically require further processing in order to be useful as the base oil. These types of oils are commonly referred to as gas-to-liquids (GTLs). For example, the hydrocarbons may be hydroisomerized using processes disclosed in U.S. Pat. No. 6,103,099 or 6,180,575; hydrocracked and hydroisomerized using processes disclosed in U.S. Pat. No. 4,943,672 or 6,096,940; dewaxed using processes disclosed in U.S. Pat. No. 5,882,505; or hydroisomerized and dewaxed using processes disclosed in U.S. Pat. Nos. 6,013,171; 6,080,301; or 6,165,949.

API Group IV base oils, PAOs, are typically derived from monomers having from 4 to 30, or from 4 to 20, or from 6 to 16 carbon atoms. Examples of PAOs that may be used in the present invention include those derived from octene, decene, mixtures thereof, and the like. PAOs may have a kinematic viscosity of from 2 to 15, or from 3 to 12, or from 4 to 8 cSt at 100° C., as measured by ASTM D2270-10. Examples of PAOs include 4 cSt at 100° C. PAOs, 6 cSt at 100° C. PAOs, and mixtures thereof.

The base oil(s) are combined with an additive composition as disclosed in embodiments herein to provide a lubricant for use in an electric motor system having an electric motor, gears, and clutches. Accordingly, the base oil may be present in the lubricating fluids in an amount greater than about 80 wt % based on the total weight of the lubricating and cooling fluid. In some embodiments, the base oil may be present in the lubricating and cooling fluid in an amount greater than about 85 wt % based on the total weight of the lubricating and cooling fluid.

Other Additives:

The electric motor driveline fluids described herein may also include other additives of the type used in electric motor fluid compositions in addition to the components described above. Such additives include, but are not limited to, antioxidant(s), viscosity modifier(s), phosphorus-containing components, detergent(s), corrosion inhibitor(s), antirust additives, antifoam agent(s), demulsifier(s), pour point depressant(s), seal swell agent(s), and additional dispersant(s), additional friction modifier(s), and additional sulfur-containing component(s).

ANTIOXIDANTS: In some embodiments, the electric motor driveline fluid contains one or more antioxidants. Suitable antioxidants include phenolic antioxidants, aromatic amine antioxidants, sulfur containing antioxidants, and organic phosphites, among others.

Examples of phenolic antioxidants include 2,6-di-tert-butylphenol, liquid mixtures of tertiary butylated phenols, 2,6-di-tert-butyl-4-methylphenol, 4,4'-methylenebis(2,6-di-tert-butylphenol), 2,2'-methylenebis(4-methyl-6-ter-t-butylphenol), and mixed methylene-bridged polyalkyl phenols, and 4,4'-thiobis(2-methyl-6-tert-butylphenol), N,N'-di-sec-butyl-phenylenediamine, 4-iisopropylaminodiphenylamine, phenyl-alpha-naphthyl amine, phenyl-alpha-naphthyl amine, and ring-alkylated diphenylamines. Examples include the sterically hindered tertiary butylated phenols, bisphenols and cinnamic acid derivatives and combinations thereof.

Aromatic amine antioxidants include, but are not limited to diarylamines having the formula:

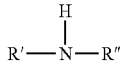

wherein R' and R" each independently represents a substituted or unsubstituted aryl group having from 6 to 30 carbon atoms. Illustrative of substituents for the aryl group include aliphatic hydrocarbon groups such as alkyl having from 1 to 30 carbon atoms, hydroxy groups, halogen radicals, carboxylic acid or ester groups, or nitro groups.

The aryl group is preferably substituted or unsubstituted phenyl or naphthyl, particularly wherein one or both of the aryl groups are substituted with at least one alkyl having from 4 to 30 carbon atoms, preferably from 4 to 18 carbon atoms, most preferably from 4 to 9 carbon atoms. It is preferred that one or both aryl groups be substituted, e.g.

mono-alkylated diphenylamine, di-alkylated diphenylamine, or mixtures of mono- and di-alkylated diphenylamines.

Examples of diarylamines that may be used include, but are not limited to: diphenylamine; various alkylated diphenylamines, 3-hydroxydiphenylamine, N-phenyl-1,2-phenylenediamine, N-phenyl-1,4-phenylenediamine, monobutyldiphenyl-amine, dibutyldiphenylamine, monooctyldiphenylamine, dioctyldiphenylamine, mononononyldiphenylamine, dinonyldiphenylamine, monotetradecyldiphenylamine, ditetradecyldiphenylamine, phenyl-alpha-naphthylamine, monooctyl phenyl-alpha-naphthylamine, phenyl-beta-naphthylamine, monoheptyldiphenylamine, diheptyl-diphenylamine, p-oriented styrenated diphenylamine, mixed butyloctyldi-phenylamine, and mixed octylstyryldiphenylamine.

The sulfur containing antioxidants include, but are not limited to, sulfurized olefins that are characterized by the type of olefin used in their production and the final sulfur content of the antioxidant. High molecular weight olefins, i.e., those olefins having an average molecular weight of 168 to 351 g/mole, are preferred. Examples of olefins that may be used include alpha-olefins, isomerized alpha-olefins, branched olefins, cyclic olefins, and combinations of these.

Alpha-olefins include, but are not limited to, any C4 to C25 alpha-olefins. Alpha-olefins may be isomerized before the sulfurization reaction or during the sulfurization reaction. Structural and/or conformational isomers of the alpha olefin that contain internal double bonds and/or branching may also be used. For example, isobutylene is a branched olefin counterpart of the alpha-olefin 1-butene.

Sulfur sources that may be used in the sulfurization reaction of olefins include: elemental sulfur, sulfur monochloride, sulfur dichloride, sodium sulfide, sodium polysulfide, and mixtures of these added together or at different stages of the sulfurization process.

Unsaturated oils, because of their unsaturation, may also be sulfurized and used as an antioxidant. Examples of oils or fats that may be used include corn oil, canola oil, cottonseed oil, grapeseed oil, olive oil, palm oil, peanut oil, coconut oil, rapeseed oil, safflower seed oil, sesame seed oil, soybean oil, sunflower seed oil, tallow, and combinations of these.

The total amount of antioxidant in the lubricating and cooling fluid described herein may be present in an amount to deliver up to about 200 ppm nitrogen, or up to about 150 ppm nitrogen, or up to about 100 ppm nitrogen.

DETERGENTS: Metal detergents that may be included in the electric motor driveline fluid described herein may generally comprise a polar head with a long hydrophobic tail where the polar head comprises a metal salt of an acidic organic compound. The salts may contain a substantially stoichiometric amount of the metal, in which case they are usually described as normal or neutral salts, and would typically have a total base number or TBN (as measured by ASTM D2896) of from 0 to less than 150. Large amounts of a metal base may be included by reacting an excess of a metal compound such as an oxide or hydroxide with an acidic gas such as carbon dioxide. The resulting overbased detergent comprises micelles of neutralized detergent surrounding a core of inorganic metal base (e.g., hydrated carbonates). Such overbased detergents may have a TBN of 150 or greater, such as from 150 to 450 or more.

Detergents that may be suitable for use in the present embodiments include oil-soluble overbased, low base, and neutral sulfonates, phenates, sulfurized phenates, and salicylates of a metal, particularly the alkali or alkaline earth metals, e.g., sodium, potassium, lithium, calcium, and magnesium. More than one metal may be present, for example, both calcium and magnesium. Mixtures of calcium and/or magnesium with sodium may also be suitable. Suitable metal detergents may be overbased calcium or magnesium sulfonates having a TBN of from 150 to 450 TBN, overbased calcium or magnesium phenates or sulfurized phenates having a TBN of from 150 to 300 TBN, and overbased calcium or magnesium salicylates having a TBN of from 130 to 350. Mixtures of such salts may also be used.

The metal-containing detergent may be present in the lubricating and cooling fluid in an amount sufficient to improve the anti-rust performance of the fluid. The metal-containing detergent may be present in the fluid in an amount sufficient to provide up to 130 ppm alkali and/or alkaline earth metal based on a total weight of the lubricating and cooling fluid.

In one approach, preferred detergents may be neutral to low base sulfonates, and in some approaches, calcium sulfonates. Suitable detergents may be calcium sulfonates having a TBN of 50 or less (such as about 25 to about 30).

VISCOSITY MODIFIERS: The electric motor driveline fluid may optionally contain one or more viscosity modifiers. Suitable viscosity modifiers may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof. Viscosity modifiers may include star polymers and suitable examples are described in US Publication No. 2012/0101017 A1.

The electric motor driveline fluid described herein also may optionally contain one or more dispersant viscosity modifiers in addition to a viscosity modifier or in lieu of a viscosity modifier. Suitable dispersant viscosity modifiers may include functionalized polyolefins, for example, ethylene-propylene copolymers that have been functionalized with the reaction product of an acylating agent (such as maleic anhydride) and an amine; polymethacrylates functionalized with an amine, or esterified maleic anhydride-styrene copolymers reacted with an amine.

The total amount of viscosity modifier and/or dispersant viscosity modifier, when present, may be up to about 1.0 wt %, or up to about 0.5 wt %, or up to about 0.3 wt % based on the total weight of the lubricating and cooling fluid.

ANTIFOAM AGENTS: Antifoam agents used to reduce or prevent the formation of stable foam include silicones, polyacrylates, or organic polymers. Foam inhibitors that may be useful in the compositions of the disclosed invention include polysiloxanes, copolymers of ethyl acrylate and 2-ethylhexylacrylate and optionally vinyl acetate. When present, the amount of antifoam in the lubricating and cooling fluid may be up about 0.1 wt, or up to about 0.05 wt %, or below about 0.04 wt % based on the total weight of the lubricating and cooling fluid.

POUR POINT DEPRESSANTS: The electric motor driveline fluid may optionally contain one or more pour point depressants. Suitable pour point depressants may include esters of maleic anhydride-styrene, polymethacrylates, polymethylmethacrylates, polyacrylates or polyacrylamides or mixtures thereof. Pour point depressants, when present, may be present in amount from about 0.001 wt % to about 0.04 wt %, based upon the total weight of the lubricant.

In general terms, a lubricating and cooling fluid described herein may include additive components in the ranges listed in Table 2.

TABLE 2

| Component | Wt % (Suitable Embodiments) | Wt % (Preferred Embodiments) |
|---|---|---|
| Succinimide Dispersant having Mn of 2000+ | 1.0-8.0 | 4.0-7.5 |
| Optional other dispersants | 0-5.0 | 0-1.0 |
| Sulfurized component | 0.05-0.5 | 0.3-0.4 |
| Friction modifiers | 0.0-0.5 | 0.0-0.4 |
| Detergent(s) | 0.05-0.5 | 0.1-0.3 |
| Antioxidant(s) | 0.1-0.6 | 0.3-0.5 |
| Antifoaming agent(s) | 0-0.05 | 0.1-0.04 |
| Viscosity index improver(s) | 0-7.0 | 0-5.0 |
| Base oil(s) | Balance | Balance |
| Total | 100 | 100 |

The percentages of each component above represent the weight percent of each component, based upon the total weight of the lubricating and cooling fluid containing the recited component. Additives used in formulating the compositions described herein may be blended into the base oil individually or in various sub-combinations. However, it may be suitable to blend all of the components concurrently using an additive concentrate (i.e., additives plus a diluent, such as a hydrocarbon solvent). The use of an additive concentrate takes advantage of the mutual compatibility afforded by the combination of ingredients when in the form of an additive concentrate. Also, the use of a concentrate reduces blending time and lessens the possibility of blending errors.

Examples

A better understanding of the present disclosure and its many advantages may be clarified with the following example. The following example is illustrative and not limiting thereof in either scope or spirit. Those skilled in the art will readily understand that variations of the components, methods, steps, and devices described in these examples can be used. Unless noted otherwise or apparent from the context of discussion in the Example below and throughout this disclosure, all percentages, ratios, and parts noted in this disclosure are by weight.

To demonstrate how the fluids herein achieve passing wear, oxidative stability, and conductivity, the inventive fluids herein are compared to fluids having various elemental relationships of nitrogen, boron, sulfur, and/or phosphorus to evaluate the wear, oxidation stability, and conductivity. The formulations were evaluated for FZG scuffing, oxidative viscosity stability, and electrical conductivity. As shown in the Tables below, inventive examples exhibited improved wear performance, conductivity performance, and oxidative stability compared to the comparative examples. The inventive examples, having the required components and at the required treat rates were thus suitable for lubricating the drivelines of electric or hybrid-electric vehicles. Comparative examples that delivered too much phosphorus, too much friction modifier, too much detergent, and/or included too much dispersant derived from a polyisobutylene having too low of a number average molecular weight, had decreased wear performance, decreased oxidative stability, and/or decreased conductivity and thus were not suitable for lubricating an electric or hybrid-electric vehicle driveline. All fluids tested herein were considered low viscosity fluids having a kV100° C. (ASTM D445) of about 3.2 to about 8 cSt.

FZG Scuffing was used to evaluate the scuffing load capacity of lubricants and was performed according to the A10/16.6R/90 test of CEC L-84-02. Results are reported in failure load stage, and better results are obtained for samples with a higher failure load stage. Inventive lubricants herein achieve a failure load stage of at least 8.

Oxidative viscosity stability was used to evaluate the difference between initial and final viscosity after aging the fluid according to CEC L-48-A-00 for 192 hours. Lower values suggest improved performance. Thus, fluids having high oxidative stability exhibit only a small change in viscosity measured before and after aging. Fluids herein have a change in viscosity of about 0.5 cSt or less.

It is beneficial for electric motor fluids to exhibit low conductivity. The conductivity of fluids was measured according to a modified version of ASTM D2624-15 (testing of a lubricant, rather than of a fuel) using a Flucon Epsilon+ at 1.5 V, 20 Hz, and at 170° C. Fluids herein have a conductivity of about 130 nS/m or less.

The Inventive and Comparative examples tested in Table 3 below all contained varying amounts of sulfurized components, friction modifiers, and dispersants as set forth in Table 3. Otherwise, each fluid contained the same additional additives including antioxidants, antifoam, corrosion inhibitor, detergent, demulsifier, and process oil. The Inventive and Comparative examples were tested in Group IV base oils to obtain finished fluids having kinematic viscosities at 100° C. as shown in the Table below. The balanced delivery of sulfur, friction modifiers, and phosphorus delivered from dispersants in the Inventive example led to surprisingly improved wear, oxidation stability, and lubricant conductivity. The Comparative examples, that delivered too much phosphorus, and/or included the relatively lower molecular weight dispersant additives, and/or contained too much friction modifier had decreased performance in wear, or oxidation stability, and/or lubricant conductivity. Details of these components used in these examples are described below:

- Sulfur Component (S-1): 2,5-dimercapto-1,3,4-thiadiazole and/or derivatives thereof containing approximately 35 wt % sulfur, which was a 75:25 to 85:15 mixture of 2,5-bis-(nonyldithio)-1,3,4-thiadiazole and 2,5-mono-(nonyldithio)-1,3,4-thiadiazole.
- Dispersant 1 (Disp-1): phosphorylated and borated succinimide dispersant made from a 950 Mn polyisobutylene, maleic anhydride, a mixture of polyalkylene polyamines having an average of 6.5 nitrogen atoms per molecule, phosphorous acid, and boric acid. This dispersant had approximately 0.76 wt % phosphorus, approximately 0.35 wt % boron, and approximately 1.75% nitrogen.
- Dispersant 2 (Disp-2): phosphorylated and borated succinimide dispersant obtained from a 2100 Mn polyisobutylene, maleic anhydride, a mixture of polyalkylene polyamines having an average of 6.5 nitrogen atoms per molecule, phosphorous acid, and boric acid. The dispersant had approximately 0.77 wt % nitrogen, about 0.15 wt % boron, and about 0.35 wt % phosphorus.
- Detergent Additive 1 (Det-1): overbased calcium sulfonate having a TBN of about 300 and about 11.9 weight percent calcium
- Friction Modifier 1 (FM-1): 1-hydroxyethyl-2-heptadecenyl imidazoline
- Friction Modifier 2 (FM-2): branched C16 to C18 substituted succinic acid or anhydride reacted with ammonia Friction Modifier 3 (FM-3): ethoxylated tallow alkyl amine

TABLE 3

Fluid Compositions

| | Inv 1 | Comp 1 | Comp 2 | Comp 3 | Comp 4 |
|---|---|---|---|---|---|
| S-1 (wt %) | 0.31 | 0.31 | 0.31 | 0.35 | 0.35 |
| Disp-1 (wt %) | — | — | — | — | 3.8 |
| Disp-2 (wt %) | 7.4 | 7.4 | 7.4 | 8.3 | — |
| FM-1 (wt %) | .02 | .02 | .02 | .02 | .02 |
| FM-2 (wt %) | 0.1 | 0.1 | 0.5 | 0.1 | 0.1 |
| FM-3 (wt %) | | .14 | | | |
| Base Oils | Gr. IV | Gr. IV | Gr. IV | Gr. IV | Gr. IV |
| kV100° C., cSt* | 6.2 | 6.2 | 6.1 | 6.4 | 6.2 |

*ASTM D445

TABLE 4

Elemental Analysis of Fluids (calculated)

| | Inv 1 | Comp 1 | Comp 2 | Comp 3 | Comp 4 |
|---|---|---|---|---|---|
| Total phosphorus (delivered from dispersant), ppm | 259 | 259 | 259 | 290 | 289 |
| Nitrogen from dispersant, ppm | 570 | 570 | 570 | 639 | 665 |
| Boron from dispersant, ppm | 111 | 111 | 111 | 125 | 133 |
| Sulfur from S-1, ppm | 1093 | 1093 | 1093 | 1225 | 1225 |
| Det-1 (ppm of calcium) | 119 | 119 | 119 | 119 | 119 |
| P/S Ratio | 0.24 | 0.24 | 0.24 | 0.24 | 0.24 |
| P + S, ppm | 1352 | 1352 | 1352 | 1515 | 1514 |

TABLE 5

Fluid Performance

| | Inv 1 | Comp 1 | Comp 2 | Comp 3 | Comp 4 |
|---|---|---|---|---|---|
| FZG, Failure Load Stage** | 8 | 6 | 7 | 8 | 8 |
| Delta Viscosity, cSt*** | 0.14 | — | — | 0.33 | 0.78 |
| Electrical Conductivity, nS/m**** | 128 | — | — | 147 | 234 |
| | PASS | FAIL | FAIL | FAIL | FAIL |

**CEC L-84-02 (A10/16.6R/90)
***CEC L-48-A
****ASTM D2624-15 (20 Hz, 170° C.) performed on a Flucon epsilon or equivalent tester Inventive example 1 had acceptable FZG performance (8 or above), improved oxidation performance (difference between initial viscosity and final viscosity after aging of 0.5 cSt or less) and improved electrical conductivity (130 nS/m or less) while the Comparative examples either had decreased FZG performance, decreased oxidation performance, and/or decreased conductivity performance.

Inventive example 2 and Comparative example 5 are shown below in Table 6. The examples were tested in Group III or Group IV/V base oils to obtain finished fluids having kinematic viscosities at 100° C. as shown in the Table below. Inventive example 2 and Comparative example 5 contained varied amounts of friction modifiers and detergent as set forth in Table 6 below. Otherwise, the examples contained similar amounts of additional additives including antioxidants, antifoam, demulsifier, and process oil. The balanced delivery of sulfur, friction modifiers, and dispersants in Inventive example 2 led to surprisingly improved wear, oxidation stability, and lubricant conductivity. Comparative example 5, contained too much friction modifier and too much detergent, and thus, had decreased performance in wear, or oxidation stability, and/or lubricant conductivity. Details of the additional components used in these examples are described below:

Dispersant 3 (Disp-3): succinimide dispersant obtained from a 950 Mn polyisobutylene, maleic anhydride, a mixture of polyalkylene polyamines having an average of 6.5 nitrogen atoms per molecule. The dispersant had approximately 2.0 wt % nitrogen.

Friction Modifier 4 (FM-4): linear C16 to C18 substituted succinic acid or anhydride reacted with ammonia Friction Modifier 5 (FM-5): a mixture of friction modifiers containing: isodecyloxypropyl monoamine, n-oleyl-1,3-diaminopropane, and dimethyl octadecylamine Antioxidant (AO): one or more antioxidants consisting of hindered phenol and alkylated diphenylamine

TABLE 6

| | Inv 2 | Comp 5 |
|---|---|---|
| S-1 (wt %) | 0.35 | .35 |
| Disp-2 (wt %) | 4.5 | 6.0 |
| Disp- 3 (wt %) | 0.4 | 0.5 |
| FM-3 (wt %) | 0.03 | 0.03 |
| FM-4 (wt %) | 0.30 | 0.40 |
| FM-5 (wt %) | — | 0.09 |
| AO | 0.7 | 0.4 |
| Balance of Base Oil and VM | Gr. III | Gr. IV/V |
| kV100° C., cSt* | 3.5 | 4.1 |

*ASTM D445

TABLE 7

Elemental Analysis of Fluids (calculated)

| | Inv 2 | Comp 5 |
|---|---|---|
| Total phosphorus (delivered from dispersant), ppm | 158 | 210 |
| Nitrogen from dispersant, ppm | 347 | 462 |
| Boron from dispersant, ppm | 68 | 90 |
| Calcium from Det-1, ppm | 119 | 214 |
| Sulfur from S-1, ppm | 1225 | 1225 |
| P/S Ratio | 0.13 | 0.17 |
| P + S, ppm | 1382 | 1435 |

TABLE 8

Fluid Performance

| | Inv 2 | Comp 5 |
|---|---|---|
| FZG, Failure Load Stage | 8 | 7 |
| Delta Viscosity, cSt*** | 0.34 | — |
| Electrical Conductivity, nS/m | 120 | 140 |
| | PASS | FAIL |

**CEC L-84-02 (A10/16.6R/90)
***CEC L-48-A
****ASTM D2624-15 (20 Hz, 170° C.) performed on a Flucon epsilon or equivalent tester Inventive example 2 had acceptable FZG performance (8 or above), improved oxidation performance (difference between initial viscosity and final viscosity after aging of 0.5 cSt or less) and improved electrical conductivity (130 nS/m or less) while the Comparative example 5 had decreased FZG performance, decreased oxidation performance, and/or decreased conductivity performance.

It is to be understood that while the lubricating composition and compositions of this disclosure have been described in conjunction with the detailed description thereof and summary herein, the foregoing description is intended to illustrate and not limit the scope of the disclosure, which is defined by the scope of the appended claims. Other aspects, advantages, and modifications are within the scope of the claims. It is intended that the specification and examples be considered as exemplary only, with a true scope of the disclosure being indicated by the following claims.

Other embodiments of the present disclosure will be apparent to those skilled in the art from consideration of the specification and practice of the embodiments disclosed herein. As used throughout the specification and claims, "a" and/or "an" may refer to one or more than one. Unless otherwise indicated, all numbers expressing quantities of ingredients, properties such as molecular weight, percent, ratio, reaction conditions, and so forth used in the specification are to be understood as being modified in all instances by the term "about," whether or not the term "about" is present. Accordingly, unless indicated to the contrary, the numerical parameters set forth in the specification are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements.

It is to be understood that each component, compound, substituent or parameter disclosed herein is to be interpreted as being disclosed for use alone or in combination with one or more of each and every other component, compound, substituent or parameter disclosed herein.

It is further understood that each range disclosed herein is to be interpreted as a disclosure of each specific value within the disclosed range that has the same number of significant digits. Thus, a range of from 1 to 4 is to be interpreted as an express disclosure of the values 1, 2, 3 and 4 as well as any range of such values such as 1 to 4, 1 to 3, 1 to 2, 2 to 4, 2 to 3 and so forth.

It is further understood that each lower limit of each range disclosed herein is to be interpreted as disclosed in combination with each upper limit of each range and each specific value within each range disclosed herein for the same component, compounds, substituent or parameter. Thus, this disclosure to be interpreted as a disclosure of all ranges derived by combining each lower limit of each range with each upper limit of each range or with each specific value within each range, or by combining each upper limit of each range with each specific value within each range.

Furthermore, specific amounts/values of a component, compound, substituent or parameter disclosed in the description or an example is to be interpreted as a disclosure of either a lower or an upper limit of a range and thus can be combined with any other lower or upper limit of a range or specific amount/value for the same component, compound, substituent or parameter disclosed elsewhere in the application to form a range for that component, compound, substituent or parameter.

What is claimed is:

1. An electric driveline fluid comprising:

one or more base oils of lubricating viscosity;

a succinimide dispersant derived from a polyisobutylene having a number average molecular weight of about 2,000 or greater, wherein the succinimide dispersant has up to about 1 weight percent nitrogen and is post treated with a phosphorus containing compound and a boron containing compound, and wherein the succinimide dispersant delivers about 150 to about 270 ppm of dispersant phosphorus (P) to the electric driveline fluid;

a sulfur-providing additive including a thiadiazole or derivative thereof, wherein the thiadiazole or derivative thereof provides at least about 1000 ppm of thiadiazole sulfur (S) to the electric driveline fluid;

wherein the combined dispersant phosphorus and thiadiazole sulfur (P+S) is at least about 1300 ppm and wherein a weight ratio of the dispersant phosphorus to the thiadiazole sulfur (P/S) is at least about 0.1;

a detergent system providing one or more calcium-containing detergents, and wherein the one or more calcium-containing detergents provide no more than about 200 ppm of calcium;

no more than about 0.4 weight percent of friction modifier; and wherein the electric driveline fluid has a kV100 viscosity of about 3.2 cSt or more, about 150 to about 270 ppm of total phosphorus, and an electrical conductivity of about 130 nS/M or less as measured by a modified conductivity test pursuant to ASTM D2624-15 using the electric driveline fluid and measured at 20 Hz and at 170° C.

2. The electric driveline fluid of claim 1, wherein the friction modifier is an alkyl imide, an alkyl amine, a hydrocarbyl imidazole, derivatives thereof, or combinations thereof.

3. The electric driveline fluid of claim 1, wherein the friction modifier is 0 to about 0.08 weight percent of an ethoxylated alkyl amine.

4. The electric driveline fluid of claim 1, wherein the organic friction modifier is 0 to about 0.4 weight percent of a linear or branched C16 to C18 substituted succinic acid or anhydride reacted with an amine, polyamine, or ammonia.

5. The electric driveline fluid of claim 1, wherein the number average molecular weight of the polyisobutylene is about 2,000 to about 2,400.

6. The electric driveline fluid of claim 5, wherein the electric motor lubricating fluid includes about 2 to about 8 weight percent of the succinimide dispersant.

7. The electric driveline fluid of claim 1, wherein the electric driveline fluid has a change in viscosity of less than 0.5 cSt after the electric driveline fluid has been aged according to CEC L-48-A.

8. The electric driveline fluid of claim 1, wherein the electric driveline fluid achieves a failure load stage of at least about 8 in the FZG A10/16.6R/120 scuffing test of CEC L-84-02.

9. The electric driveline fluid of claim 1, wherein the thiadiazole or derivative thereof provides about 1500 ppm or less of sulfur.

10. The electric driveline fluid of claim 1, wherein the combined dispersant phosphorus and thiadiazole sulfur (P+S) is about 1300 ppm to about 1400 ppm.

11. The electric driveline fluid of claim 1, wherein the weight ratio of the dispersant phosphorus to the thiadiazole sulfur (P/S) is about 0.1 to about 0.3.

12. The electric driveline fluid of claim 1, wherein about 90 to about 100 percent of the total phosphorus is provided by the succinimide dispersant.

13. The electric driveline fluid of claim 12, wherein the amount of provided phosphorus is about 1 ppm of phosphorus per each 8 to 13 number average molecular weight units of the polyisobutylene moiety of the succinimide dispersant.

14. The electric driveline fluid of claim 1, wherein the thiadiazole or derivative thereof includes one or more compounds having a structure of Formula I:

(Formula III)

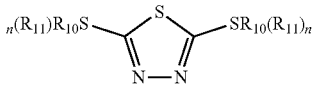

wherein each $R_{10}$ is, independently, hydrogen or sulfur;

each $R_{11}$ is, independently, an alkyl group;

n is an integer of 0 or 1 and if $R_{10}$ is hydrogen then the integer n of the adjacent $R_{11}$ moiety is 0 and if $R_{10}$ is sulfur then the n of the adjacent $R_{11}$ moiety is 1; and wherein at least one $R_{10}$ is sulfur.

15. A method for lubricating a driveline component including an electric motor, the method comprising:

lubricating the driveline component with an electric driveline fluid;

the electric driveline fluid includes (i) one or more base oils of lubricating viscosity; (ii) a succinimide dispersant derived from a polyisobutylene having a number average molecular weight of about 2,000 or greater, wherein the succinimide dispersant has up to about 1 weight percent nitrogen and is post treated with a phosphorus containing compound and a boron containing compound, and wherein the succinimide dispersant delivers about 150 to about 270 ppm of dispersant phosphorus (P) to the electric driveline fluid; (iii) a sulfur-providing additive including a thiadiazole or derivative thereof providing at least about 1000 ppm of thiadiazole sulfur (S) to the electric driveline fluid, wherein the combined dispersant phosphorus and thiadiazole sulfur (P+S) is at least about 1300 ppm and wherein a weight ratio of the dispersant phosphorus to the thiadiazole sulfur (P/S) is at least about 0.1; (iv) a detergent system providing one or more calcium-containing detergents, wherein the one or more calcium-containing detergents provide no more than about 200 ppm of calcium; and (v) no more than about 0.4 weight percent of a friction modifier; and wherein the electric driveline fluid has a kV100 viscosity of about 3.2 cSt or more, about 150 to about 270 ppm of total phosphorus, and an electrical conductivity of about 130 nS/M or less as measured by a modified conductivity test pursuant to ASTM D2624-15 using the electric driveline fluid and measured at 20 Hz and at 170° C.

16. The method for lubricating a driveline component including an electric motor of claim 15, wherein the friction modifier is an alkyl imide, an alkyl amine, a hydrocarbyl imidazole, derivatives thereof, or combinations thereof.

17. The method for lubricating a driveline component including an electric motor of claim 15, wherein the friction modifier is 0 to about 0.08 weight percent of an ethoxylated alkyl amine.

18. The method for lubricating a driveline component including an electric motor of claim 15, wherein the friction modifier is 0 to about 0.4 weight percent of a linear or branched C16 to C18 substituted succinic acid or anhydride reacted with an amine, polyamine, or ammonia.

19. The method for lubricating a driveline component including an electric motor of claim 15, wherein the number average molecular weight of the polyisobutylene is about 2,000 to about 2,400.

20. The method for lubricating a driveline component including an electric motor of claim 19, wherein the electric driveline fluid includes about 2 to about 8 weight percent of the succinimide dispersant.

21. The method for lubricating a driveline component including an electric motor of claim 15, wherein the electric driveline fluid has a change in viscosity after aging of less than about 0.5 cSt after the electric driveline fluid has been aged according to CEC L-48-A.

22. The method for lubricating a driveline component including an electric motor of claim 15, wherein the electric driveline fluid achieves a failure load stage of at least about 8 in the FZG A10/16.6R/120 scuffing test of CEC L-84-02.

23. The method for lubricating a driveline component including an electric motor of claim 15, wherein about 90 to about 100 percent of the total phosphorus is provided by the succinimide dispersant.

24. The method for lubricating a driveline compound including an electric motor of claim 15, wherein the thiadiazole or derivative thereof includes one or more compounds having a structure of Formula III:

(Formula III)

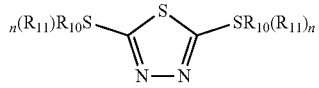

wherein each $R_{10}$ is, independently, hydrogen or sulfur;

each $R_{11}$ is, independently, an alkyl group;

n is an integer of 0 or 1 and if $R_{10}$ is hydrogen then the integer n of the adjacent $R_{11}$ moiety is 0 and if $R_{10}$ is sulfur then the n of the adjacent $R_{11}$ moiety is 1; and wherein at least one $R_{10}$ is sulfur.

* * * * *